US009909308B2

(12) United States Patent
Kwon

(10) Patent No.: US 9,909,308 B2
(45) Date of Patent: Mar. 6, 2018

(54) COMPOSITE BEAM HAVING TRUSS REINFORCEMENT EMBEDDED IN CONCRETE

(71) Applicant: Yong Keun Kwon, Hanam-si (KR)

(72) Inventor: Yong Keun Kwon, Hanam-si (KR)

( * ) Notice: Subject to any disclaimer, the term of this patent is extended or adjusted under 35 U.S.C. 154(b) by 0 days.

(21) Appl. No.: 15/108,290

(22) PCT Filed: Jan. 27, 2016

(86) PCT No.: PCT/KR2016/000899
§ 371 (c)(1),
(2) Date: Jun. 25, 2016

(87) PCT Pub. No.: WO2016/133291
PCT Pub. Date: Aug. 25, 2016

(65) Prior Publication Data

US 2018/0002925 A1 Jan. 4, 2018

(30) Foreign Application Priority Data

Feb. 16, 2015 (KR) ..... 10-2015-0023632

(51) Int. Cl.
*E04B 5/40* (2006.01)
*E04C 3/29* (2006.01)
(Continued)

(52) U.S. Cl.
CPC ..... *E04B 5/40* (2013.01); *E04C 3/205* (2013.01); *E04C 3/291* (2013.01); *E04C 3/293* (2013.01);
(Continued)

(58) Field of Classification Search
CPC ..... E04B 5/40; E04C 3/293
See application file for complete search history.

(56) References Cited

U.S. PATENT DOCUMENTS 3,579,937 A * 5/1971 Lukens ..... E04C 2/205 264/46.7
4,905,440 A * 3/1990 Schilger ..... E04C 3/293 52/368
(Continued)

FOREIGN PATENT DOCUMENTS

JP 2015001063 A 1/2015
KR 1020060042561 A 5/2006
(Continued)

OTHER PUBLICATIONS

International Preliminary Report on Patentability for PCT/KR2016/000899 including English translation dated Aug. 22, 2017 (11 pages).*
(Continued)

*Primary Examiner* — Rodney Mintz
(74) *Attorney, Agent, or Firm* — Paratus Law Group, PLLC

(57) ABSTRACT

The present invention relates to a composite beam in which a fabricated truss is embedded in the concrete, and more particularly, it relates to a composite beam in which the fabricated truss acts as a truss beam which endures the concrete weight and the construction load in the liquid phase before the curing of the concrete and acts as a main structural member together with the concrete after the curing of the concrete.

10 Claims, 14 Drawing Sheets

(51) Int. Cl.

| | |
|---|---|
| ***E04C 3/293*** | (2006.01) |
| ***E04C 5/065*** | (2006.01) |
| ***E04C 3/20*** | (2006.01) |
| *E04B 1/41* | (2006.01) |
| *E04B 1/24* | (2006.01) |
| *E01D 101/26* | (2006.01) |

(52) U.S. Cl.
CPC ..... *E04C 5/065* (2013.01); *E01D 2101/262* (2013.01); *E04B 2001/2448* (2013.01); *E04B 2001/2457* (2013.01); *E04B 2001/4192* (2013.01)

(56) References Cited

U.S. PATENT DOCUMENTS 6,807,789 B1 * 10/2004 Kim ..... E01D 19/125 52/847
8,281,534 B2 * 10/2012 Bae ..... E04B 5/40 52/333
8,813,445 B2 * 8/2014 Kim ..... E04B 5/263 52/220.1
9,518,388 B1 * 12/2016 Wang ..... E04B 1/161
2004/0182027 A1 * 9/2004 Bonacci ..... E04B 5/29 52/319
2008/0282633 A1 * 11/2008 Buckholt ..... E04B 1/78 52/309.8
2008/0282644 A1 * 11/2008 Hong ..... E04C 3/293 52/847
2010/0287878 A1 * 11/2010 Lee ..... E04B 1/944 52/834
2012/0023858 A1 * 2/2012 Lee ..... E04C 5/0645 52/636
2012/0079782 A1 * 4/2012 Kim ..... E04B 5/263 52/220.1
2014/0096476 A1 * 4/2014 Kim ..... E04B 1/20 52/841

FOREIGN PATENT DOCUMENTS

KR 1020130043324 A 4/2013
KR 1020130131061 A 12/2013
KR 101469798 B1 12/2014
WO WO 2016043386 A1 * 3/2016 ..... E04B 5/16

OTHER PUBLICATIONS

KIPO Office Action Notice With Cited References dated Jun. 29, 2015.

* cited by examiner

COMPOSITE BEAM HAVING TRUSS REINFORCEMENT EMBEDDED IN CONCRETE

CROSS-REFERENCE TO RELATED APPLICATIONS

This application is a 371 of PCT/KR2016/000899 filed Jan. 27, 2016, which claims the benefit of foreign priority of Korean Patent Application No. 10-2015-0023632 filed Feb. 16, 2015, the subject matter of which is hereby incorporated by reference in its entirety.

BACKGROUND

(a) Technical Field

The present invention relates to a composite beam in which a fabricated truss is embedded in the concrete, and more particularly, it relates to a composite beam in which the fabricated truss acts as a truss beam which endures the concrete weight and the construction load in the liquid phase before the curing of the concrete and acts as a main structural member together with the concrete after the curing of the concrete.

(b) Background Art

Reinforced concrete structure requires a sheathing board to maintain a shape of the concrete of the liquid phase during the curing period of the concrete and requires a catgut, yoke and support for controlling the structural safety and deflection at the time of construction. Therefore, since the reinforced concrete structure is accompanied with additional processes such as removal of a form, removal of the support or the like, there is a disadvantage that the construction is difficult and the construction period is lengthened.

A steel structure does not require a separate erection work at the time of construction, however, has problems that the material cost is higher than the reinforced concrete structure and the steel member is exposed so that the durability and the refractory property are deteriorated.

To mutually compensate such problems of the reinforced concrete structure and the steel structure, the steel reinforced concrete composite beam has been developed. The steel reinforced concrete composite beam has advantages that it is embodied in such a way that a steel beam and the concrete behave as a single member, therefore, it is an efficient structural member so that when it is subjected to a deflection moment, most of the compression stress is taken by the concrete and the tension stress is taken by the steel material, and the height of the beam can be reduced so that the height of the layer of the building construction can be reduced and the resistance strength and the resistance rigidity are increased so that a long-span construction is possible and the ultimate performance or the transformation performance is increased.

The steel reinforced concrete composite beam has been developed for various shapes for long time, and one among them is the steel permanent form type composite beam in which the section of the steel material is concentrated at the tension side sheath of the constructional member and the concrete is filled in the inside. Since the concrete is confined by the steel plate and the deflection rigidity is increased and the concrete is not exposed, there are advantages that the crack and the neutralization are prevented so as to improve the durability. In addition, since the composite beam and the concrete of a slab are integrally poured and cured, the constructional integrity is secured and since a separate form is not used, an economical and environment friendly construction method is provided.

The technology as a background of the present invention is the patent registration 10-1469798 "Steel plate fabricated composite beam" (Patent document 1). This patent suggests a composite beam which comprises a pair of web plates arranged parallel so as to be spaced a predetermined distance and a lower flange connecting the pair of web plates each other so as to form a lower surface of the composite, and which is formed by assembling plural steel plates so as to fill the inside with the concrete. The steel plate fabricated composite beam suggested by this patent has an advantage that since there is no protrusion to the side of the web plate by combining the web plate to the side surface of the lower flange, the portion of the structure itself where the dust is accumulated can be removed, however, since the steel plate unit manufactured in U form so as to function as a permanent form is usually composed of a thin plate of which the thickness of the steel plate is about 6 mm, there is a disadvantage that the section rigidity is very small, so that when filling the concrete inside of the steel unit and when assembling the reinforcing bar to a floor plate and pouring the concrete thereto, it is difficult to support the construction load, therefore, since the construction is carried out by placing supports at intermediate places of the steel plate unit at the construction stage, it is difficult to anticipate the site construction operability and the construction period saving, and the steel unit which is exposed to the outside is very weak to the fire.

PRIOR ART TECHNOLOGY DOCUMENT

Patent Document (Patent document 1) Patent registration 10-1469798 "Steel plate fabricated composite beam"

SUMMARY OF THE DISCLOSURE

The present invention is to solve the problems which the above described prior art technology has, and an object of the present invention is to provide a composite beam which does not expose the steel plate to the outside, excludes the use of the support, improves the durability and the refractory, and reduces the entire construction period and cost.

In addition, another object of the present invention is to embody a structural member which can endure the construction load efficiently by making the upper chord, the lower chord and the folding type web member in a truss shape through the assembly of them.

In addition, another object of the present invention is to improve the transportability, construction convenience and quality at the time of construction by mass production at the factory by standardization of each part, and through the assembly excluding the welding at the construction site.

A flush type fabricated truss composite beam attached with a sheathing board according to an appropriate embodiment shape of the present invention comprises a fabricated truss, a sheathing board and a concrete, wherein the fabricated truss comprises: a lower chord consisted in a plate shape of a predetermined thickness, wherein screw rods formed with a screw thread on both ends or along the entire length are combined to the lower chord with a predetermined spacing along a length direction so as to protrude in the width direction; a pair of folding type web members composed in a zigzag form by connecting ends of plural flat steels, wherein the screw rod combined to the lower chord penetrates a penetrating hole formed at a connecting portion of the flat steel and a D cone is screwed so that the lower ends of the folding type web member are combined to both ends of the lower chord in the width direction; and a pair of upper chords comprising a vertical plate at which combination holes are pierced along the length direction with a predetermined spacing and a horizontal plate composed at the upper end of the vertical plate, wherein the screw rod penetrates the combination hole of the vertical plate and the upper penetration hole of the folding type web member, and a D cone is screwed at the outside so that the pair of upper chords are combined to the pair of folding type web members, wherein the sheathing board is formed to receive the fabricated truss in its section and have a U shape section in which the upper surface is opened, and bolt holes are pierced at positions corresponding to the D cone combined to the upper chord and the lower chord of the fabricated truss and a bolt is combined to the D cone through the bolt hole at the outside so that the sheathing board is fixed to the fabricated truss, wherein the concrete is integrated with the fabricated truss by being poured into the section of the sheathing board, and wherein the sheathing board is removed by unscrewing the bolt after curing of the concrete.

A flush type fabricated truss composite beam attached with a sheathing board according to an appropriate embodiment shape of the present invention comprises a fabricated truss, a sheathing board and a concrete, wherein the fabricated truss comprises: a lower chord consisted in a plate shape of a predetermined thickness, wherein screw rods formed with a screw thread on both ends or along the entire length are combined to the lower chord with a predetermined spacing along a length direction so as to protrude in the width direction; a pair of folding type web members composed in a zigzag form by connecting ends of plural flat steels, wherein the screw rod combined to the lower chord penetrates a penetrating hole formed at a connecting portion of the flat steel and a D cone is screwed so that the lower ends of the folding type web member are combined to both ends of the lower chord in the width direction; and a pair of upper chords comprising a vertical plate at which combination holes are pierced along the length direction with a predetermined spacing and a horizontal plate composed at the upper end of the vertical plate, wherein the screw rod penetrates the combination hole of the vertical plate and the upper penetration hole of the folding type web member, and a D cone is screwed at the outside so that the pair of upper chords are combined to the pair of folding type web members, wherein the sheathing board is formed to receive the fabricated truss in its section and have a U shape section in which the upper surface is opened, and bolt holes are pierced at positions corresponding to the D cone combined to the upper chord and the lower chord of the fabricated truss and a bolt is combined to the D cone through the bolt hole at the outside so that the sheathing board is fixed to the fabricated truss, wherein the concrete is integrated with the fabricated truss by being poured into the section of the sheathing board.

At this time, the upper chord can be composed of T shape steel or ¬ shape steel.

In addition, wherein the sheathing board can be formed by a pair of side wall sheathing boards and a U shape lower sheathing board so that the lower ends of a pair of side wall sheathing boards are overlapped at both sides of the U shape lower sheathing board.

In the meantime, the flush type fabricated truss composite beam attached with a sheathing board can further comprise a T shape steel which is composed in such a way that the lower end of the vertical plate is combined to the upper surface of the horizontal plate of the upper chord so that the T shape steel protrudes in the shape of T.

Here, the folding type web member can embody one of shapes of a Warren truss, a Pratt truss and a double Warren truss.

In the meantime, the flat steel can be composed in a shape of a pair of dumbbells in which the sections of both ends of the flat steel can be increased as much as the size of the penetrating hole.

Effect of the Present Invention

A flush type fabricated truss composite beam attached with a sheathing board according to an appropriate embodiment shape of the present invention can anticipate the following effects.

First, there is an effect that since the fabricated truss acts as the construction member which can efficiently endure the construction load and the concrete weight, the support can be excluded, and since it can secure a wide operation space, the construction convenience can be improved, and since a framework can be first installed without waiting the curing of the concrete, the construction period can be reduced.

Second, if the sheathing board is removed after curing of the concrete, since the lower chord, the upper chord and the folding type web member all do not contact external apparatus but are buried in the concrete, the endurance and the refractory can be improved.

Third, the screw rod combining the upper chord, the lower chord and the folding type web member acts as a fore end connection member which makes the concrete and the fabricated truss to act integrally so as to improve the structural performance of the flush type composite beam.

Fourth, the folding type web member can improve reduce the transportation fee and the deposit fee and the construction convenience by reducing the volume by folding at the stage of transportation and deposit, by expanding and assembling at the time of assembly and installation.

Fifth, since the upper chord and the upper chord of the flush type fabricated truss composite beam from which the sheathing board is removed after curing of the concrete act as the deflection reinforcing member and the folding type web member acts as the shear reinforcing member, the structural performance is superior and the rigidity against the deflection and the vibration is superior compared to the conventional exposed type composite beam.

BRIEF DESCRIPTION OF THE DRAWINGS

The following accompanying drawings in the present specification exemplify preferred embodiments of the present invention and play a role of detailed description of the present invention and further making the technical thoughts of the present invention, and therefore, the present invention shall not be interpreted by being limited to the items described in the accompanying drawings.

DETAILED DESCRIPTION

Although the present invention will be described in detail below with reference to the accompanying drawings, the suggested embodiments are only for exemplification of the present invention for the definite understanding of the present invention and the present invention is not limited to them.

Figure 1:
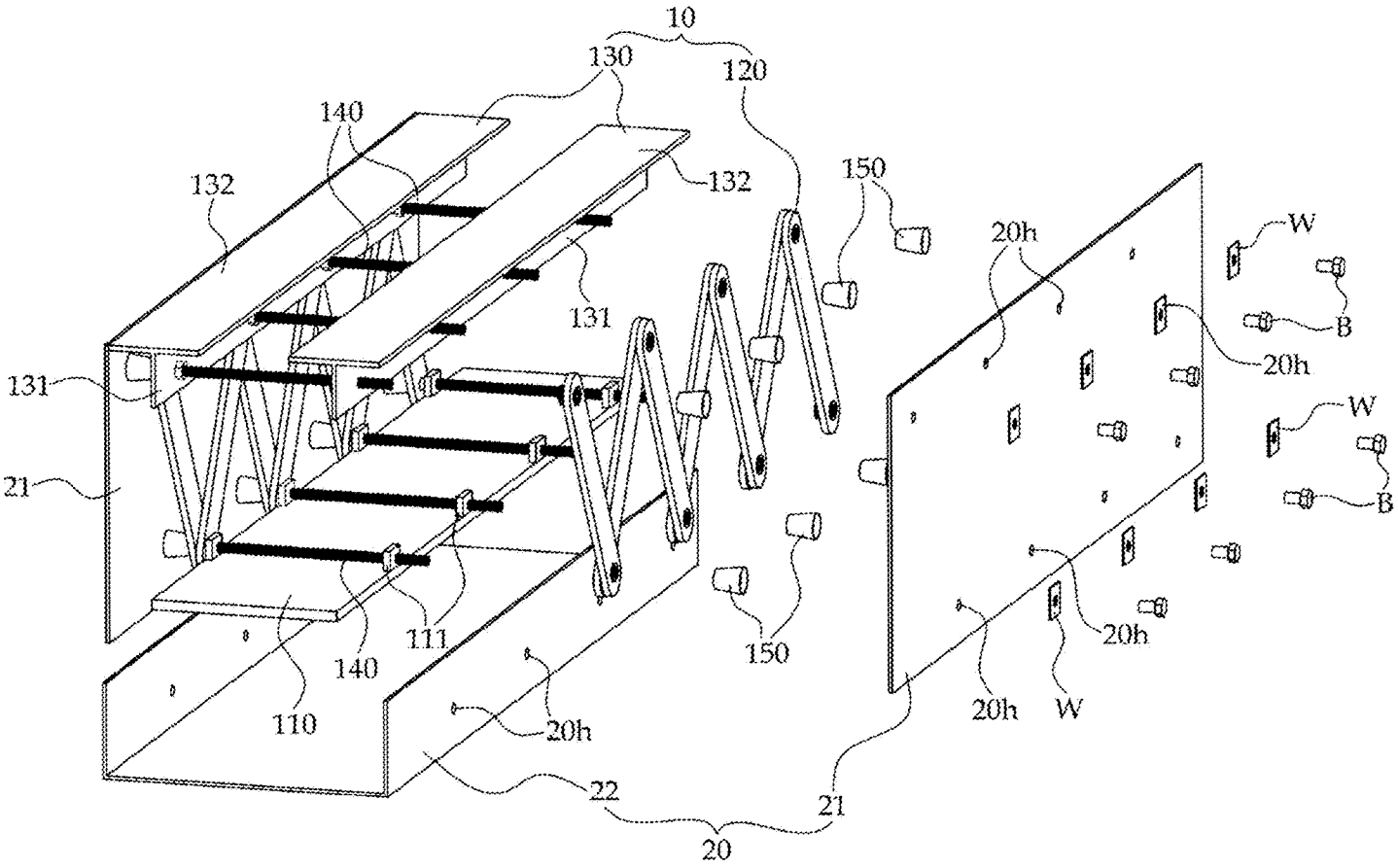
FIG. 1 is an exploded perspective view of a flush type fabricated truss composite beam attached with a sheathing board according to an embodiment of the present invention.
Figure 2A:
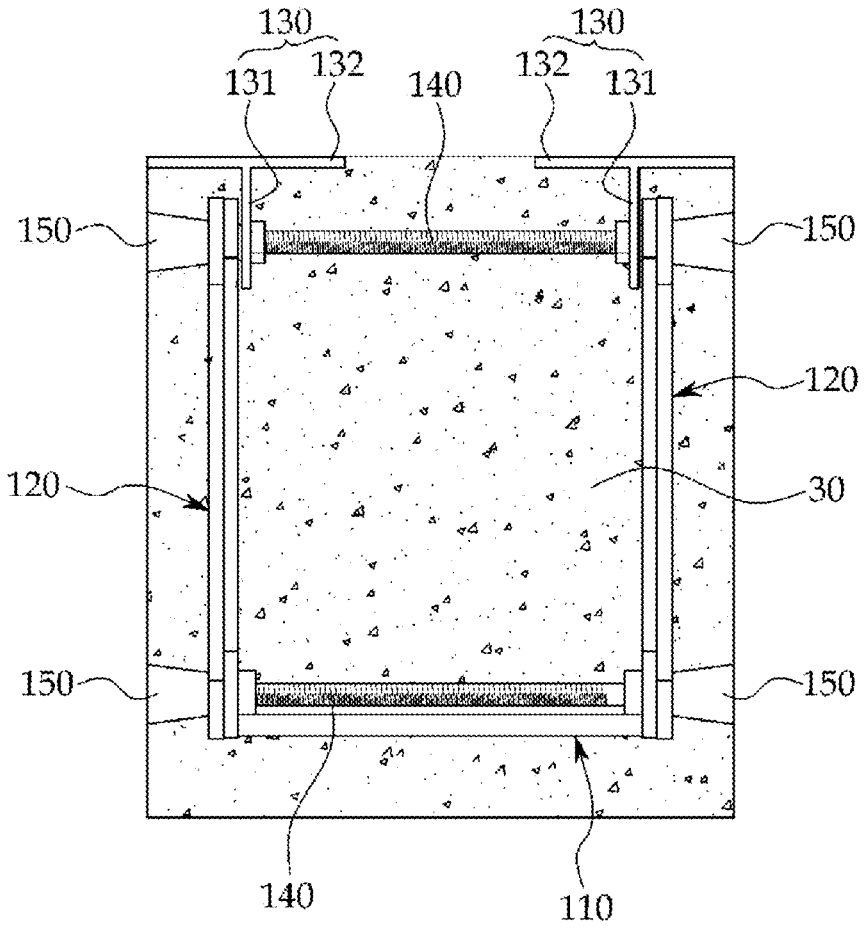
FIGS. 2A and 2B are sectional views.
Figure 2B:
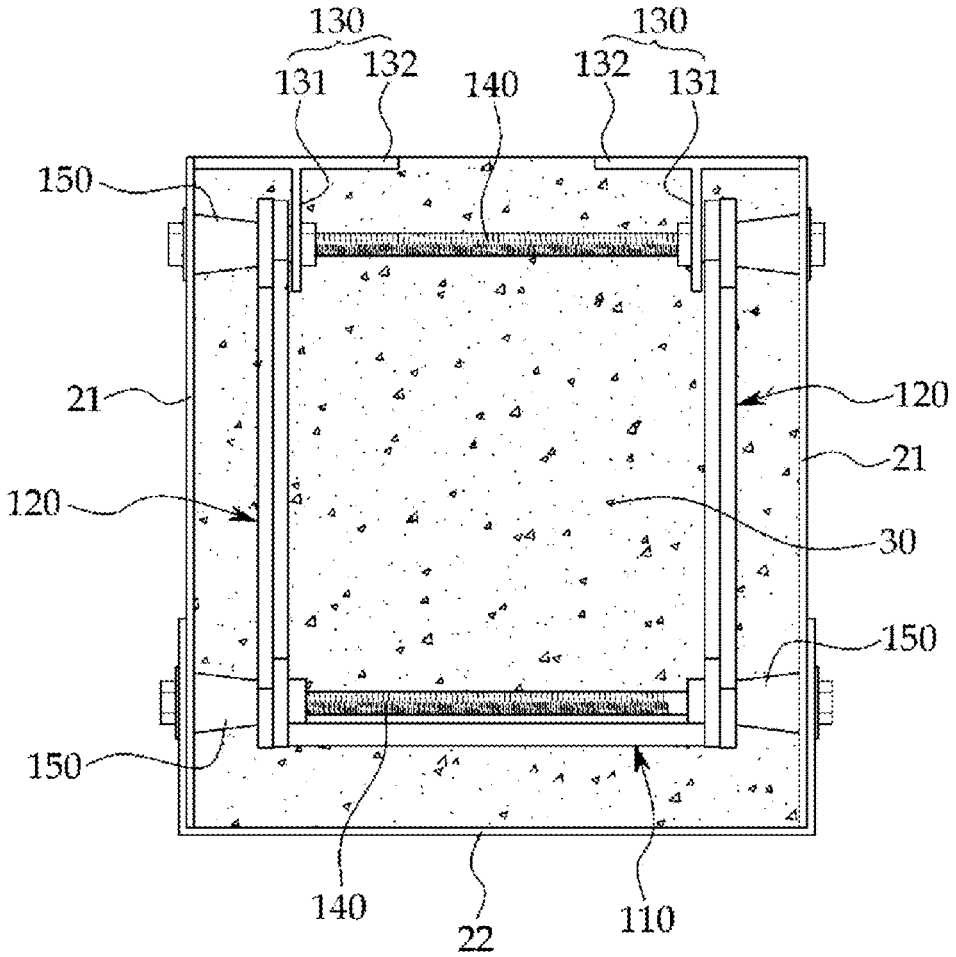

FIG. 1 is an exploded perspective view of a flush type fabricated truss composite beam attached with a sheathing board according to an embodiment of the present invention and FIG. 2 is a sectional view.

The flush type fabricated truss composite beam attached with the sheathing board according to the present invention largely comprises a fabricated truss 10, a sheathing board 20, and a concrete 30.

The fabricated truss 10 is consisted of a truss member consisting of a lower chord, a web member and an upper chord, and the lower chord 110 of the fabricated truss 10 according to the present invention is consisted in a plate shape of a predetermined thickness, and to the lower chord are combined screw rods 140 with a predetermined spacing along a length direction in a direction normal to the length direction. The screw rod 140 is formed with a screw thread on both ends or along the entire length, and is formed to have a length larger than the width of the lower chord 110 so that both ends protrude beyond the lower chord 110 in the width direction. The screw rod 140 can be directly combined to the lower chord 110 by an arbitrary method such as direct welding, and preferably can be combined so that plural fixed plates 111 formed with penetrating holes on an equal line in width direction are formed on the upper surface of the lower chord 110 and the screw rod 140 can penetrate the fixed plate 111. It is preferable that the fixed plate 111 is attached in advance by ways such as welding at the factory.

A folding type web member 120 is an inclined member which is combined at its lower end to the lower chord and at its upper end to the upper chord so as to connect the lower chord and the upper chord. The folding type web member 120 of the present invention is composed in a zigzag form by connecting ends of plural flat steels 121 and the detailed shape will be described later. At the lower end and upper end (connecting portion of flat steel 121) of the folding type web member 120 are formed with penetrating holes, a screw rod 140 combined to the lower chord 110 penetrates the penetrating hole, and at the penetrated screw rod 140 is screwed a D cone 150. For the D cone 150, one usually referred to as a D cone or a D cone nut in this field can be used. The folding type web members 120 are combined to both ends of the lower chord 110 in the width direction, that is, a pair of folding type web members 120 maintain a spacing as much as the width of the lower chord 110 and are combined to the lower chord 110 in a direction normal to the lower chord.

The upper chord 130 is combined to the upper end of the folding type web member 120, and at the upper ends of a pair of the folding type web members 120 are combined a pair of the upper chords 130 so that they entirely compose a U type section together with the lower chord 110. The upper chord 130 comprises a vertical plate 131 which provides a combination surface with the folding type web member 120 and a horizontal plate 132 to which a later described deck plate is seated at its upper surface, and as the upper chord 130 the T shape steel can be used as shown and although not shown the angle member can be used. The vertical plate 131 of the upper chord 130 is pierced with combination holes for the combination, and like the lower chord 110, the upper chord 130 also can be combined to the folding type web member 120 through the screw rod 140 and the D cone 150. The screw rod 140 penetrates the combination hole of the vertical plate 131 of the upper chord 130 and the upper penetration hole of the folding type web member 120, and at the penetrated screw rod 140 is screwed a D cone 150. At this time, it is preferable to first combine a nut to the inside of the upper chord 130 so that the upper chords 130 at both sides can maintain a predetermined spacing, and then combine the D cone 150 to the upper end outside of the folding type web member.

The screw rod 140 is a means for combining the lower chord 110 and the upper chord 130 to the folding type web member 120 and at the same time acts as a fore end connection member which makes the concrete 30 and the fabricated truss 10 to act integrally so as to improve the structural performance of the composite beam.

The fabricated truss 10 composed of the above described lower chord 110, folding type web member 120 and upper chord 130 are made to endure the construction load at the construction stage and the weight of the concrete in liquid phase, and after the curing of the concrete, the upper chord 130 becomes a deflection reinforcing member acting as the upper reinforced bar of the reinforced concrete, the lower chord 110 becomes a deflection reinforcing member acting as the lower reinforced bar, and the folding type web member 120 becomes a shear reinforcing member acting as a stirrup of the reinforced concrete beam. According to the necessity, the reinforced bar can be further installed and the selection of the member of the upper chord 130, lower chord 110 and folding type web member 120 are according to the structural calculation.

The sheathing board 20 is composed to receive the fabricated truss 10 in its section and to have the section in which the upper surface is opened, and at the sheathing board 20 are pierced with bolt holes **20*h* at positions corresponding to the D cone 150 combined to the upper chord 130 and the lower chord 110 of the fabricated truss 10, and a bolt is combined to the D cone 150 through the bolt hole 20*h* at the outside of the sheathing board 20 so that the sheathing board 20 is fixed to the fabricated truss 10**.

The sheathing board 20 can be combined to the fabricated truss 10 with simple bolt screwing and can be removed from the fabricated truss 10 by unscrewing the bolt in the opposite direction. That is, the sheathing board 20 of the present invention is devised to be easily removed, and act as the sheathing board for housing the concrete 30 of the liquid phase in the construction stage, however, after the curing of the concrete 30, can be removed together with the bolt as shown in FIG. **2*a* so as to make the concrete 30 to be exposed. There are advantages that since the concrete structure is exposed, the defect such as leakage or crack is visualized, the defect repair can be clearly carried out and since the removed sheathing board 20 can be reused in other floor or other construction site, it can be environment-friendly and economical and can reduce the construction period. The present invention is based on removing the sheathing board 20 after curing of the concrete 30, however, the present invention is not limited to this and according to the necessity, the sheathing board can be a structural member together with the fabricated truss 10 and the concrete 30 by leaving the sheathing board 20 as it is as shown in FIG. 2***b*.

The sheathing board 20 can be formed integral as a form having a U shape section, and can be formed by a pair of side wall sheathing boards 21, 21 and a U shape lower sheathing board 22 so that the lower ends of a pair of side wall sheathing boards 21 can be overlapped at both sides of the U shape lower sheathing board 22 as shown in FIGS. 1 and 2. At the time of composing the side wall sheathing board 21 and the lower sheathing board 22 separately and combining them, since the side pressure due to the concrete of the liquid phase is higher at the upper portion of the beam than the lower portion of the beam at the timed of pouring the concrete into the section of the sheathing board, if the lower sheathing board 22 is made to be thicker than the side wall sheathing board 21, it can endure efficiently than composing the sheathing board 20 integrally in a constant thickness. As the material of the sheathing board 20, arbitrary one well known in this field such as the hard fiber board, synthetic resin, aluminum panel, steel plate or the like can be used.

Since the fabricated truss 10 is composed of steel material, the coating thickness is required, and the coating thickness of the upper chord 130 is secured by the slab composed at the upper part of the composite beam and that of the folding type web member 120 is secured by the D cone 150, so the one requiring the consideration the coating thickness of the lower chord 110. Therefore, the shape of the section of the sheathing board 20 shall be determined in its depth by considering the coating thickness of the lower chord 110.

The concrete 30 is integrated with the fabricated truss 10 by being poured in the section of the sheathing board 20. Since the concrete has large specific gravity and the sheathing board itself has very small sectional rigidity, the sheathing board has difficulty in enduring the construction load at the time of filling the inside of the sheathing board with the concrete, therefore a support is required, however, according to the present invention, since the fabricated truss 10 resists the construction load effectively by the tension and pressing action of the truss member, the support is not required and the operability of the construction at the site is improved and the reduction of the construction period can be anticipated.

At the time of pouring the concrete, it is preferable to integrally compose the composite beam and the slab by placing a deck plate D on the upper part of the composite beam, that is, the horizontal plate 132 of the upper chord 130 of the fabricated truss 10 and by pouring and curing the concrete in the section of the sheathing board 20 and on the upper part of the deck plate D.

Figure 3A:
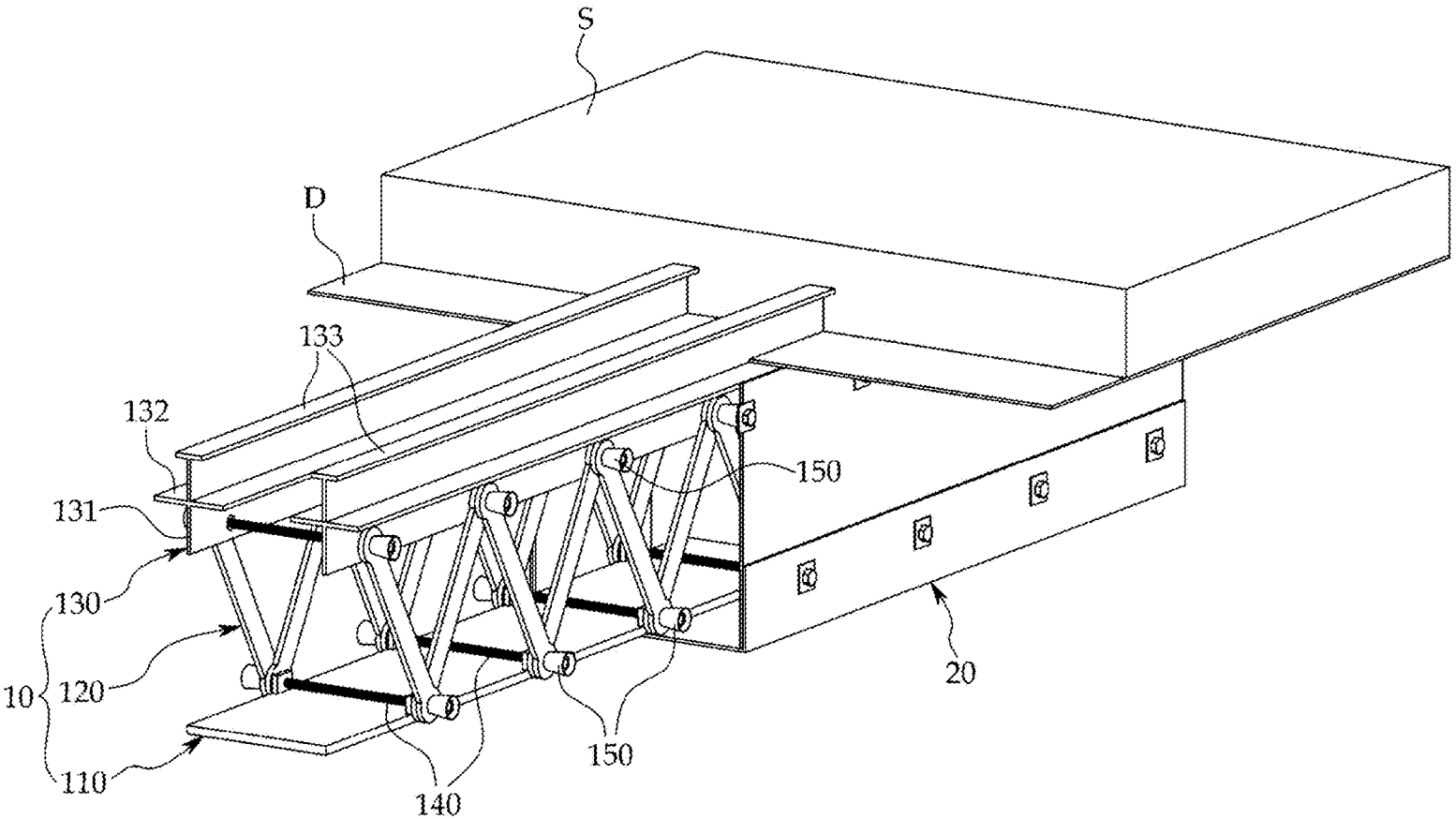
FIG. 3*a* is a perspective view of the flush type fabricated truss composite beam attached with a sheathing board according to another embodiment of the present invention.
Figure 3B:
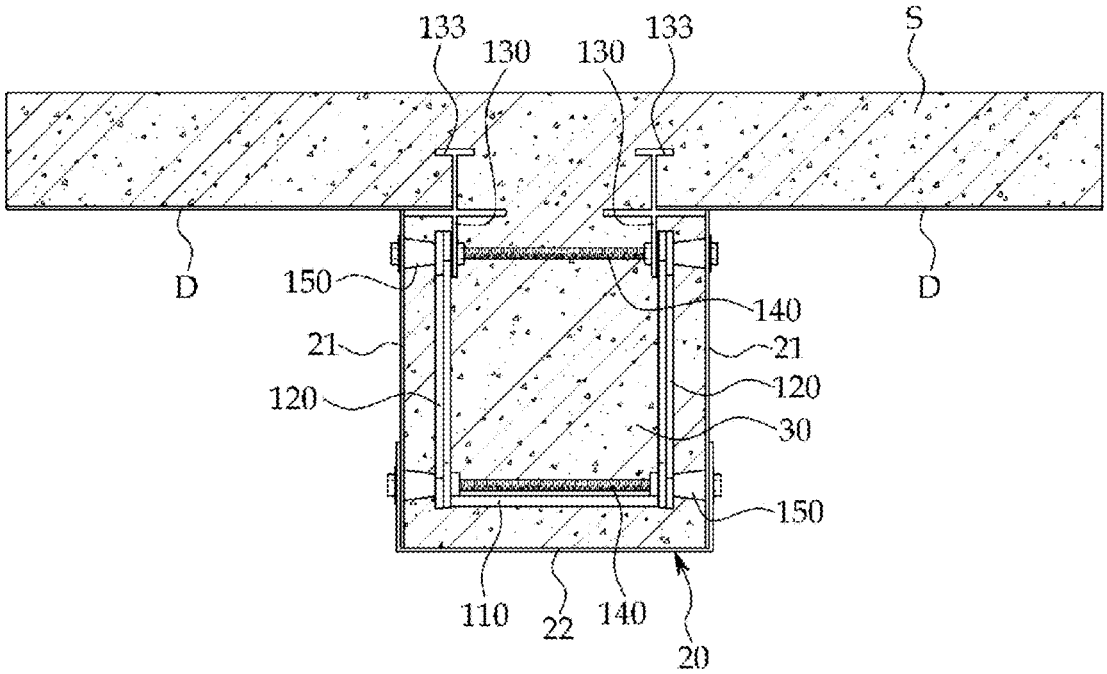
FIG. 3*b* is a sectional view.

FIG. 3*a* is a perspective view of the flush type fabricated truss composite beam attached with a sheathing board according to another embodiment of the present invention, and FIG. 3*b* is a sectional view.

The present embodiment further comprises a T shape steel 133 which is combined to the upper part of the upper chord 130. The T shape steel 133 is further installed on the upper part of the upper chord 130, that is, the lower end of the vertical plate of T shape steel 133 is combined on the upper surface of the horizontal plate 132 of the upper chord 130 so that the T shape steel 133 protrudes on the upper end of the upper chord 130 so as to protrude in the shape of T. Accordingly, as shown in FIG. 3, the T shape steel 133 is embedded in the slab S and the upper chord 130 is made to behave integrally with the slab S. That is, the T shape steel 133 protruding into the slab increases the integration of the fabricated truss 10, the inner side of the section of the sheathing board 20, and the concrete filled into the upper part of the deck plate D. In addition, since the sectional rigidity is increased, the rigidity of the structural member is also increased so that the sufficient rigidity is secured so that the deflection, vibration or other deformation does not occur under the construction load, and in particular, at the time of applying to the negative bending moment interval, there is an effect that the rigidity is increased by placing the steel materials in the tension zone.

FIG. 4 is a top view showing various shapes of a flat steel of a folding type web member of the present invention.

Figure 4A:
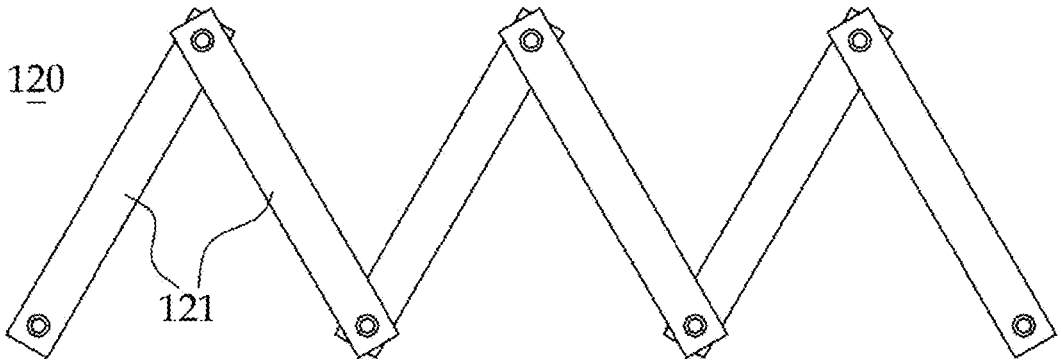
FIGS. 4A, 4B and 4C are top views showing various shapes of a flat steel of a folding type web member of the present invention.
Figure 4B:
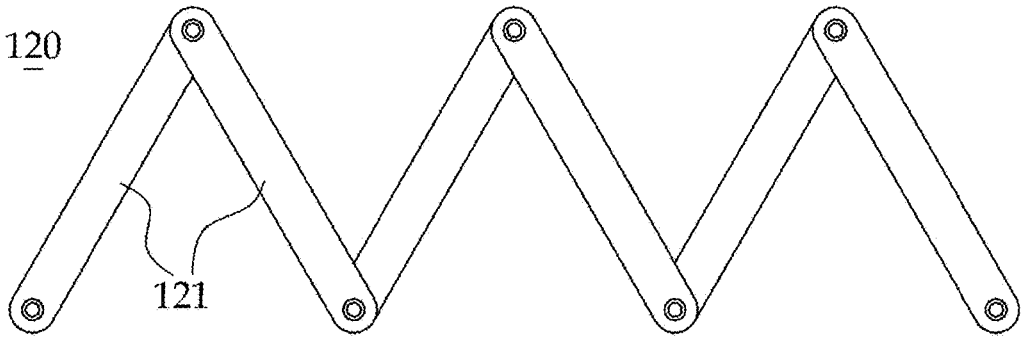
Figure 4C:
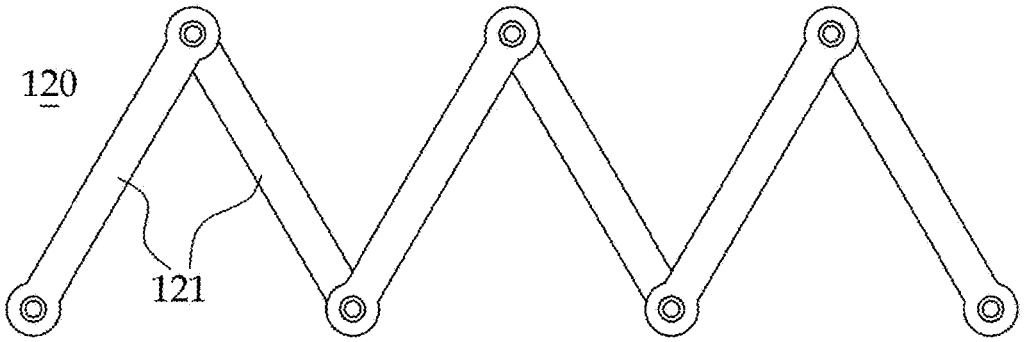

The folding type web member 120 of the present invention is composed to connect the ends of the plural flat steels 121 as described above, the shape of the flat steel 121 can be a general rectangular shape as shown in FIG. 4*a* or can be a shape in which the end of the flat steel is trimmed to be round as shown in FIG. 4*b*, and in particular, both ends of the flat steel can be composed in a shape of a pair of dumbbells in which the section is increased as much as the size of the penetrating hole as shown in FIG. 4*c* so as to plan the effective use of the amount of steel.

FIG. 5 is a side view showing various shapes of the folding type web member of the present invention.

Figure 5A:
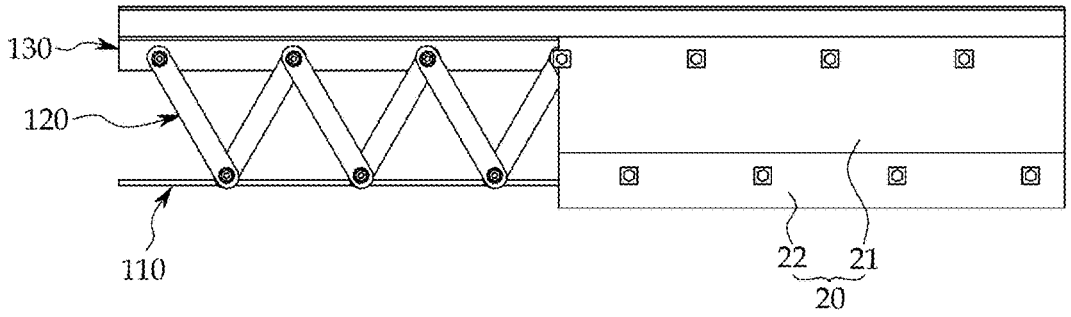
FIGS. 5A, 5B and 5C are side views showing various shapes of the folding type web member of the present invention.
Figure 5B:
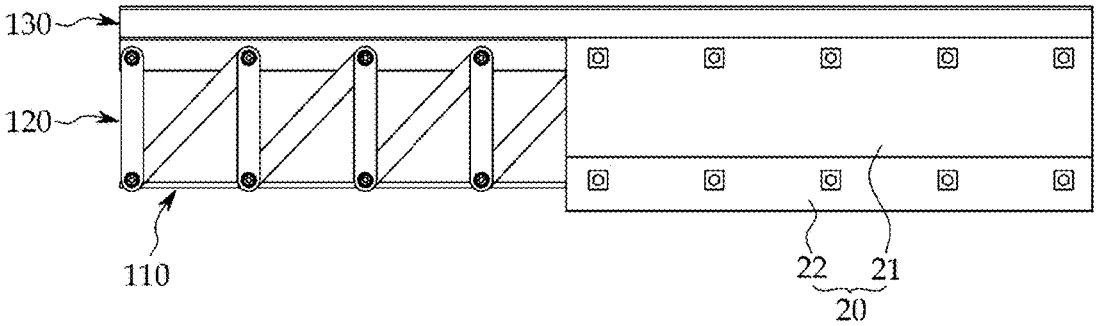
Figure 5C:
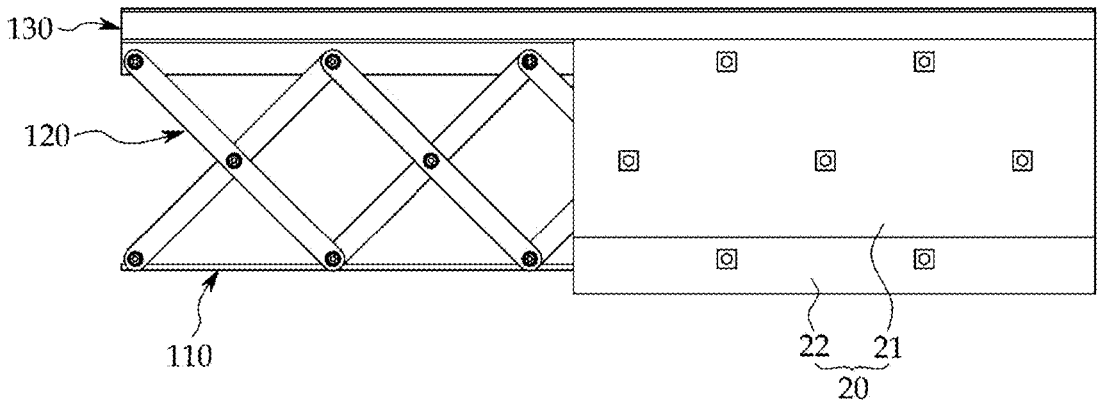

The folding type web member 120 according to the present invention is formed of the inclined members which compose the truss member by connecting the upper chord and the lower chord and can be composed to embody various truss shapes. If the shape of Warren truss is embodied as shown in FIG. 5*a*, the fabricated truss of superior construction convenience and transportation of the web member can be embodied, and if the shape of Pratt truss is embodied as shown in FIG. 5*b*, the fabricated truss can be embodied which has the superior structural efficiency since the vertical member of short length receives the compression stress and the inclined member of long length receives the tension stress and the superior shear rigidity since both the vertical member and the inclined member act the role of the stirrup. In particular, in case where the height of the beam is large, it is preferable to compose the folding type web member 120 in the shape of a double Warren truss as shown in FIG. 5*c*. In case where the height of the beam is large, the side pressure acting on the folding type web member 120 at the time of pouring the concrete becomes large, and at this time, if the folding type web member 120 is composed in the shape of the double Warren truss and the D cone 150 is further installed at the cross point of the flat steel 121, then since the number of the support points at the sheathing board 20 is increased, the fabricated truss 10 which can reduce the thickness of the sheathing board 20 can be embodied.

FIG. 6 is a top view showing a shape in which the folding type web member of the present invention is folded.

Figure 6A:
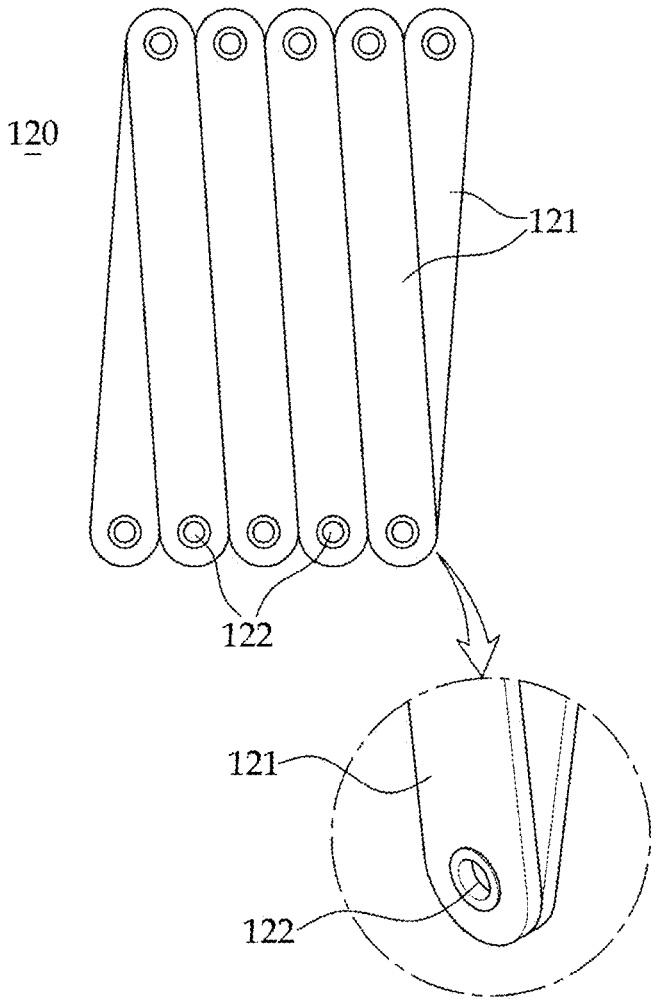
FIGS. 6A, 6B and 6C are top views showing a shape in which the folding type web member of the present invention is folded.
Figure 6B:
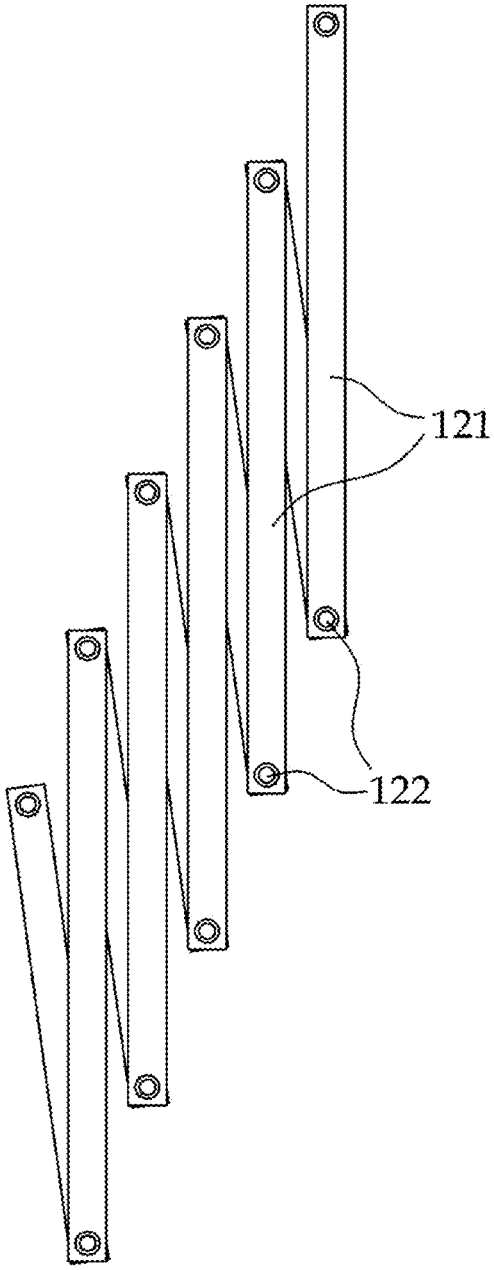
Figure 6C:
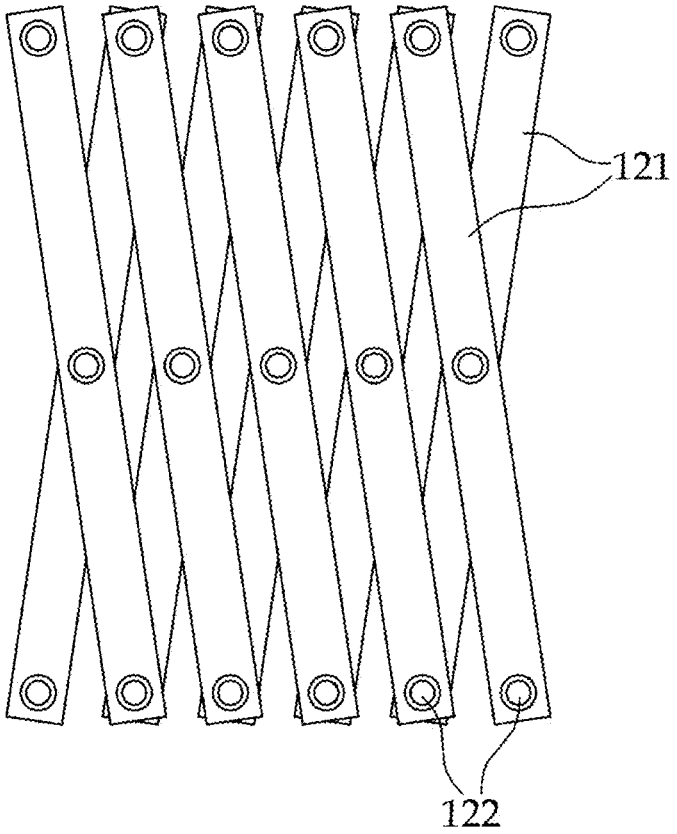

FIGS. 6*a* to 6*c* respectively show the folded shapes of the folding type web members having the shapes of the Warren truss, Pratt truss and double Warren truss of FIGS. 5*a* to 5*c*. In composing the folding type web member 120 by connecting the ends of the flat steel 121, if a hinge cap 122 is connected with the flat steel 121 as a medium so as to be rotatable while maintaining the penetrating hole at the connection part, the folding type web member can be folded so as to have small volume as shown in FIG. 6. Therefore, the folding type web member 120 can improve reduce the transportation fee and the deposit fee and the construction convenience by reducing the volume by folding at the stage of transportation and deposit, by expanding and assembling at the time of assembly and installation.

According to the present invention described above, there is an effect that since the fabricated truss acts as the construction member which can efficiently endure the construction load and the concrete weight, the support can be excluded, and since it can secure a wide operation space, the construction convenience can be improved, and since a framework can be first installed without waiting the curing of the concrete, the construction period can be reduced.

In addition, if the sheathing board is removed after curing of the concrete, since the lower chord, the upper chord and the folding type web member all do not contact external apparatus but are buried in the concrete, the endurance and the refractory can be improved.

In addition, the folding type web member can improve reduce the transportation fee and the deposit fee and the construction convenience by reducing the volume by folding at the stage of transportation and deposit, by expanding and assembling at the time of assembly and installation.

In addition, since the upper chord and the upper chord of the flush type fabricated truss composite beam from which the sheathing board is removed after curing of the concrete act as the deflection reinforcing member and the folding type web member acts as the shear reinforcing member, the structural performance is superior and the rigidity against the deflection and the vibration is superior compared to the conventional exposed type composite beam.

The present invention has been described in detail with reference to the suggested embodiments, however, it will be appreciated that those skilled in the art may make various changes and amendment invention with reference to the suggested embodiments without departing from the technical thoughts of the invention. The present invention is not limited by such changes and amendment invention but limited by the claims accompanying below.

What is claimed is:

1. A fabricated truss composite beam attached with a sheathing board, comprising:

a fabricated truss;

the sheathing board; and a concrete, wherein the fabricated truss comprises:

a lower chord in a plate shape having a predetermined thickness, wherein first screw rods having a screw thread are combined to the lower chord with a predetermined spacing along a length direction of the lower chord so as to protrude from sides of the lower chord in a width direction of the lower chord;

a pair of foldable web members arranged along the sides of the lower chord and composed in a zigzag form by connecting ends of plural flat steels, wherein each first screw rod combined to the sides of the lower chord penetrates a penetrating hole formed at a connecting portion of each flat steel and a first D cone is screwed at an end of each first screw rod so that lower ends of the foldable web members are combined to the sides of the lower chord; and a pair of upper chords comprising a vertical plate at which combination holes are pierced along a length direction of each upper chord with a predetermined spacing and a horizontal plate composed at an upper end of the vertical plate, wherein second screw rods penetrate the combination holes of the vertical plate and upper penetration holes of the foldable web members, and a second D cone is screwed at an end of each second screw rod so that the pair of upper chords are combined to the pair of foldable web members, wherein the sheathing board is formed by a pair of side wall sheathing boards and a U shape lower sheathing board so that lower ends of the pair of side wall sheathing boards are overlapped at sides of the U shape lower sheathing board so as to have a U shape section in which an upper surface of the sheathing board is opened so as to receive the fabricated truss in the sheathing board, and bolt holes are pierced at positions corresponding to the first D cone and the second D cone and bolts are combined to the first D cone and the second D cone through the bolt holes at an outside of the pair of side wall sheathing boards so that the sheathing board is fixed to the fabricated truss, wherein the concrete is integrated with the fabricated truss by being poured into the sheathing board, and wherein the sheathing board is configured to be removed by unscrewing the bolts after the concrete is cured.

2. The fabricated truss composite beam attached with a sheathing board of claim 1, wherein the upper chord is composed of T shape steel or ⊓ shape steel.

3. The fabricated truss composite beam attached with a sheathing board of claim 1, further comprises a T shape steel which is composed in such a way that a lower end of the T shape steel is combined to an upper surface of the horizontal plate of each upper chord so that the T shape steel protrudes in a shape of T on each upper chord.

4. The fabricated truss composite beam attached with a sheathing board of claim 1, wherein each foldable web member includes one of shapes of a Warren truss, a Pratt truss, and a double Warren truss.

5. The fabricated truss composite beam attached with a sheathing board of claim 1, wherein each flat steel includes ends opposite to each other and each having the penetrating hole.

6. A fabricated truss composite beam attached with a sheathing board, comprising:

a fabricated truss;

the sheathing board; and a concrete, wherein the fabricated truss comprises:

a lower chord in a plate shape having a predetermined thickness, wherein first screw rods having a screw thread are combined to the lower chord with a predetermined spacing along a length direction of the lower chord so as to protrude from sides of the lower chord in a width direction of the lower chord;

a pair of foldable web members arranged along the sides of the lower chord and composed in a zigzag form by connecting ends of plural flat steels, wherein each first screw rod combined to the sides of the lower chord penetrates a penetrating hole formed at a connecting portion of each flat steel and a first D cone is screwed at an end of each first screw rod so that lower ends of the foldable web members are combined to the sides of the lower chord; and a pair of upper chords comprising a vertical plate at which combination holes are pierced along a length direction of each upper chord with a predetermined spacing and a horizontal plate composed at an upper end of the vertical plate, wherein second screw rods penetrate the combination holes of the vertical plate and upper penetration holes of the foldable web members, and a second D cone is screwed at an end of each second screw rod so that the pair of upper chords are combined to the pair of foldable web members, wherein the sheathing board is formed by a pair of side wall sheathing boards and a U shape lower sheathing board so that lower ends of the pair of side wall sheathing boards are overlapped at sides of the U shape lower sheathing board so as to have a U shape section in which an upper surface of the sheathing board is opened so as to receive the fabricated truss in the sheathing board, and bolt holes are pierced at positions corresponding to the first D cone and the second D cone and bolts are combined to the first D cone and the second D cone through the bolt holes at an outside of the pair of side wall sheathing boards so that the sheathing board is fixed to the fabricated truss, and wherein the concrete is integrated with the fabricated truss by being poured into the sheathing board.

7. The fabricated truss composite beam attached with a sheathing board of claim 6, wherein the upper chord is composed of T shape steel or ¬ shape steel.

8. The fabricated truss composite beam attached with a sheathing board of claim 6, further comprises a T shape steel which is composed in such a way that a lower end of the T shape steel is combined to an upper surface of the horizontal plate of each upper chord so that the T shape steel protrudes in a shape of T on each upper chord.

9. The fabricated truss composite beam attached with a sheathing board of claim 6, wherein each foldable web member includes one of shapes of a Warren truss, a Pratt truss, and a double Warren truss.

10. The fabricated truss composite beam attached with a sheathing board of claim 6, wherein each flat steel includes ends opposite to each other and each having the penetrating hole.

* * * * *